US011122850B2

(12) United States Patent
Hutchinson et al.

(10) Patent No.: US 11,122,850 B2
(45) Date of Patent: Sep. 21, 2021

(54) ARTICLE HAVING A KNITTED COMPONENT WITH A STRAP

(71) Applicant: NIKE, Inc., Beaverton, OR (US)

(72) Inventors: Helene Hutchinson, Portland, OR (US); Elizabeth Langvin, Sherwood, OR (US); Tetsuya T. Minami, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 54 days.

(21) Appl. No.: 15/472,627

(22) Filed: Mar. 29, 2017

(65) Prior Publication Data

US 2017/0280817 A1 Oct. 5, 2017

Related U.S. Application Data

(60) Provisional application No. 62/317,255, filed on Apr. 1, 2016.

(51) Int. Cl.
*A43B 1/04* (2006.01)
*A43B 23/02* (2006.01)
(Continued)

(52) U.S. Cl.
CPC ..... *A43B 1/04* (2013.01); *A41D 27/10* (2013.01); *A41D 27/205* (2013.01);
(Continued)

(58) Field of Classification Search
CPC .. A43C 1/14; A43C 7/02; A43C 7/005; A43C 7/06; A43B 3/0031; A43B 23/0235;
(Continued)

(56) References Cited

U.S. PATENT DOCUMENTS 2,147,197 A * 2/1939 Glidden ..... A43B 1/02 36/9 R
2,526,663 A * 10/1950 Holland ..... A41B 11/00 2/239
(Continued)

FOREIGN PATENT DOCUMENTS

CN 1678782 A 10/2005
CN 101562999 A 10/2009
(Continued)

OTHER PUBLICATIONS

Office Action of the Intellectual Property Office of Taiwan dated Mar. 1, 2018 for Taiwan Patent Application No. 106111254, with English translation (23 pages).
(Continued)

*Primary Examiner* — Heather Mangine
(74) *Attorney, Agent, or Firm* — Shook, Hardy & Bacon L.L.P.

(57) ABSTRACT

In one aspect, the present disclosure provides an article formed of a knitted component. The article may be an upper for an article of footwear. The knitted component may have a first portion and a second portion, where the first portion of the knitted component at least partially forms a foot-receiving portion of the upper, where the second portion of the knitted component at least partially forms a strap of the upper, where the strap includes a first edge and a second edge secured to the first portion of the knitted component, and where the strap includes a third edge that extends from the first edge to the second edge.

20 Claims, 11 Drawing Sheets

(51) Int. Cl.

| | |
|---|---|
| ***D04B 1/22*** | (2006.01) |
| ***A41D 27/10*** | (2006.01) |
| ***A41D 27/20*** | (2006.01) |
| ***A43B 23/26*** | (2006.01) |
| ***A43C 1/04*** | (2006.01) |
| ***A43C 11/14*** | (2006.01) |

(52) U.S. Cl.
CPC ..... *A43B 23/027* (2013.01); *A43B 23/0275* (2013.01); *A43B 23/26* (2013.01); *A43C 1/04* (2013.01); *A43C 11/14* (2013.01); *D04B 1/22* (2013.01); *A41D 2500/10* (2013.01)

(58) Field of Classification Search
CPC ..... A43B 23/0265; A43B 23/0277; A43B 23/0275; A43B 23/0245; A43B 23/024; D04B 1/26
USPC ..... 36/45, 47, 48, 49, 50.1, 112; D2/943
See application file for complete search history.

(56) References Cited

U.S. PATENT DOCUMENTS 2,539,026 A * 1/1951 Mangold ..... A43B 5/0486 36/117.8
2,836,909 A * 6/1958 Richards ..... A43B 7/32 36/72 R
3,102,347 A * 9/1963 Griswold ..... A43C 13/14 36/72 R
4,040,275 A * 8/1977 Castello ..... D04B 1/246 66/64
4,114,297 A * 9/1978 Famolare, Jr. ..... A43C 11/008 24/306
4,308,672 A * 1/1982 Antonious ..... A43C 11/1493 24/306
4,377,913 A * 3/1983 Stone ..... A43C 11/1493 36/50.1
4,441,265 A * 4/1984 Burns ..... A43B 7/20 36/114
4,516,337 A * 5/1985 Adamik ..... A43B 3/0031 2/245
4,640,025 A * 2/1987 DeRenzo ..... A43C 11/1493 36/114
RE32,585 E * 2/1988 Antonious ..... A43C 11/1493 24/306
4,813,158 A * 3/1989 Brown ..... A43B 5/00 36/114
4,815,222 A * 3/1989 Eisenbach ..... A43B 5/14 36/131
4,901,451 A * 2/1990 Cumin ..... A43B 5/00 36/170
4,972,609 A * 11/1990 Oh ..... A43B 5/00 36/114
5,042,119 A * 8/1991 Williams ..... A43B 3/0031 24/442
5,377,430 A * 1/1995 Hatfield ..... A43B 3/08 24/714.6
5,421,106 A * 6/1995 Emrick ..... A43B 3/0031 36/136
5,694,703 A * 12/1997 Diaz ..... A43B 3/163 36/7.1 R
5,701,688 A * 12/1997 Crowley ..... A43B 23/26 36/101
5,727,337 A * 3/1998 Okajima ..... A43B 5/04 24/306
5,771,608 A * 6/1998 Peterson ..... A43B 5/00 36/50.1
6,000,111 A * 12/1999 Deskins ..... A43C 7/02 24/442
6,606,804 B2 * 8/2003 Kaneko ..... A43B 7/1495 36/50.1
6,772,541 B1 * 8/2004 Ritter ..... A43B 7/14 36/50.1
7,082,703 B2 * 8/2006 Greene ..... A43B 3/0026 36/128
D635,748 S * 4/2011 Katz ..... D2/902
7,941,943 B2 * 5/2011 Baker ..... A43B 5/02 36/133
8,429,836 B1 * 4/2013 Tomor ..... A43B 1/0081 36/100
8,438,708 B1 * 5/2013 Tuck ..... A43C 7/005 24/712.3
8,448,474 B1 * 5/2013 Tatler ..... A43B 23/0245 66/64
D691,356 S * 10/2013 Whittington ..... D2/943
8,677,653 B2 * 3/2014 Avar ..... A43B 3/242 36/50.1
D719,725 S * 12/2014 Katz ..... D2/902
8,973,410 B1 * 3/2015 Podhajny ..... A43B 23/024 66/177
9,084,449 B2 * 7/2015 Bell ..... A43B 1/04
9,192,204 B1 * 11/2015 Liles ..... A43C 1/04
9,301,567 B2 * 4/2016 Dealey ..... A43B 1/04
9,510,636 B2 * 12/2016 Dua ..... A43B 1/04
9,578,925 B1 * 2/2017 Michel ..... A43B 3/0031
9,681,704 B2 * 6/2017 Podhajny ..... A43B 23/0205
9,723,890 B2 * 8/2017 Long ..... A43B 1/04
9,723,891 B2 * 8/2017 Xanthos ..... A43C 11/1493
9,730,484 B2 * 8/2017 Dua ..... A43B 1/04
9,848,672 B2 * 12/2017 Podhajny ..... A43B 23/0245
9,861,161 B2 * 1/2018 Meschter ..... A43B 23/227
9,907,363 B2 * 3/2018 Smith ..... A43B 3/126
9,936,757 B2 * 4/2018 Podhajny ..... A43B 1/04
2002/0124436 A1 * 9/2002 Hatfield ..... A43B 3/163 36/45
2003/0041475 A1 * 3/2003 Liu ..... A43C 11/1493 36/50.1
2004/0163285 A1 * 8/2004 Johnson ..... A43B 1/0081 36/136
2004/0181972 A1 * 9/2004 Csorba ..... A43B 7/1495 36/50.1
2005/0178026 A1 * 8/2005 Friton ..... A43B 23/26 36/50.1
2006/0027615 A1 * 2/2006 Masi ..... A43B 3/0031 224/222
2006/0117606 A1 * 6/2006 Chen ..... A43B 7/223 36/50.1
2006/0130359 A1 * 6/2006 Dua ..... A43B 1/04 36/9 R
2007/0261269 A1 * 11/2007 Petrie ..... A43C 11/008 36/50.1
2008/0110004 A1 * 5/2008 Franzino ..... A43C 7/005 24/712.2
2008/0110049 A1 * 5/2008 Sokolowski ..... A43B 3/0031 36/50.1
2009/0277043 A1 * 11/2009 Graser ..... A43C 1/04 36/91
2010/0037483 A1 * 2/2010 Meschter ..... A43B 3/26 36/47
2010/0154256 A1 * 6/2010 Dua ..... A43B 1/04 36/25 R
2011/0113650 A1 * 5/2011 Hurd ..... A43B 23/08 36/107
2011/0203137 A1 * 8/2011 Long ..... A43B 5/12 36/91
2012/0011744 A1 * 1/2012 Bell ..... A43B 1/0072 36/91
2012/0079741 A1 * 4/2012 Kohatsu ..... A43B 3/26 36/50.1
2012/0255201 A1 * 10/2012 Little ..... A43B 1/04 36/84
2013/0025157 A1 * 1/2013 Wan ..... A43B 7/06 36/45
2013/0192091 A1 * 8/2013 Kohatsu ..... A43B 23/026 36/103
2013/0255040 A1 * 10/2013 Scott ..... A43C 7/02 24/306
2014/0137433 A1 * 5/2014 Craig ..... A43B 1/04 36/50.1

(56) References Cited

U.S. PATENT DOCUMENTS

| | | | | |
|---|---|---|---|---|
| 2014/0196313 | A1* | 7/2014 | Hatfield | A43B 3/06 36/83 |
| 2014/0196316 | A1* | 7/2014 | Follet | A43B 23/0245 36/84 |
| 2014/0310996 | A1* | 10/2014 | Waters | A43B 3/0031 36/136 |
| 2015/0068061 | A1* | 3/2015 | Farris | A43B 13/38 36/83 |
| 2015/0075031 | A1* | 3/2015 | Podhajny | A43B 1/04 36/45 |
| 2015/0082662 | A1* | 3/2015 | Farris | A41F 15/002 36/84 |
| 2015/0289584 | A1* | 10/2015 | Nurse | A43B 3/0031 36/89 |
| 2016/0037863 | A1* | 2/2016 | Harley | A43C 13/00 36/72 R |
| 2016/0058128 | A1* | 3/2016 | Dalton | A43C 7/02 36/50.1 |
| 2016/0066651 | A1* | 3/2016 | Terai | D04B 1/24 36/45 |
| 2016/0120264 | A1* | 5/2016 | Bardini | A43C 1/00 36/50.1 |
| 2016/0198798 | A1* | 7/2016 | Ikenaka | D04B 1/22 36/45 |
| 2016/0206045 | A1* | 7/2016 | Meir | A43B 23/0205 |
| 2016/0302524 | A1* | 10/2016 | Smith | A43B 13/12 |
| 2017/0042290 | A1* | 2/2017 | Hatfield | A43B 3/242 |
| 2017/0202310 | A1* | 7/2017 | Spanks | A43B 3/101 |
| 2017/0224047 | A1* | 8/2017 | Walker | A43B 1/0054 |
| 2017/0238645 | A1* | 8/2017 | Arin | A43B 1/0081 |
| 2017/0265585 | A1* | 9/2017 | Orand | A43B 3/0005 |
| 2017/0273403 | A1* | 9/2017 | Pauk | A43B 13/12 |
| 2018/0064210 | A1* | 3/2018 | Turner | A43B 1/0072 |
| 2018/0110295 | A1* | 4/2018 | Dyer | A43C 1/06 |
| 2018/0168271 | A1* | 6/2018 | Ly | A43B 1/04 |
| 2018/0255863 | A1 | 9/2018 | Kuo et al. | |
| 2018/0271216 | A1* | 9/2018 | La O' | A43B 23/0235 |
| 2019/0008235 | A1* | 1/2019 | Wu | A43C 1/04 |
| 2019/0037966 | A1* | 2/2019 | Aceves Tinajero | A43B 23/024 |
| 2019/0090587 | A1* | 3/2019 | Wu | D04B 1/106 |

FOREIGN PATENT DOCUMENTS

| | | | |
|---|---|---|---|
| CN | 101583294 | A | 11/2009 |
| CN | 102860632 | A | 1/2013 |
| CN | 104246040 | A | 12/2014 |
| CN | 204181071 | U | 3/2015 |
| CN | 105324050 | A | 2/2016 |
| JP | 2006204407 | A | 8/2006 |
| JP | 2011083432 | A | 4/2011 |
| JP | 3191011 | U | 6/2014 |
| TW | 201607448 | A | 3/2016 |
| TW | 201615114 | A | 5/2016 |
| WO | WO 2014 203584 | A1 | 12/2014 |
| WO | WO 2015/025678 | A1 | 2/2015 |

OTHER PUBLICATIONS

Communication from the European Patent Office dated Nov. 8, 2018 for EP Application No. 17716035.5 (3 pg.).

International Preliminary Report on Patentability and Written Opinion dated Oct. 2, 2018 for PCT Application No. PCT/US2017/024316 (13 pp.).

Decision of the Intellectual Property Office for Taiwan Patent Application No. 106111254 dated Mar. 6, 2019 (with English translation) (15 pg.).

Office Action dated Sep. 18, 2019 for Chinese Application No. 201780022208.5 with English Translation, 7 pages.

Office Action dated Dec. 9, 2019 for Taiwanese Patent Application No. 106111254, 4 pages.

Second Office Action of the China National Intellectual Property Administration for Chinese Patent Application No. 2017800222085 dated Jul. 31, 2020 (with English translation) (9 pgs.).

* cited by examiner

ARTICLE HAVING A KNITTED COMPONENT WITH A STRAP

CROSS-REFERENCE TO RELATED APPLICATION

This application claims the benefit of U.S. Provisional Application No. 62/317,255, filed Apr. 1, 2016, which is herein incorporated by reference in its entirety.

BACKGROUND

A variety of articles are at least partially formed from textiles. As examples, apparel (e.g., shirts, pants, socks, footwear, jackets and other outerwear, briefs and other undergarments, hats and other headwear), containers (e.g., backpacks, bags), and upholstery for furniture (e.g., chairs, couches, car seats) are often at least partially formed from textiles. These textiles are often formed by weaving or interlooping (e.g., knitting) a yarn or a plurality of yarns, usually through a mechanical process involving looms or knitting machines. One particular object that may be formed of a textile is an upper for an article of footwear.

A conventional article of footwear generally includes two primary elements: an upper and a sole structure. The upper may be secured to the sole structure and forms a void within the article of footwear for comfortably and securely receiving a foot. The sole structure may be secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and forms a ground-engaging portion of the sole structure that is formed from a wear-resistant material.

The upper of the article of footwear generally extends at least over the instep and toe regions of the foot, along the medial and lateral sides of the foot, and around the heel region of the foot. Access to the void on the interior of the upper is generally provided by an ankle opening in a heel region of the article of footwear. A lacing system is often incorporated into the upper to adjust the fit of the upper, thereby facilitating entry and removal of the foot from the void within the upper. In addition, the upper may include a tongue that extends under the lacing system to enhance adjustability of the article of footwear, and the upper may incorporate a heel counter to limit movement of the heel.

DESCRIPTION

In one aspect, a method for forming an article may include knitting a first portion of a knitted component, wherein the first portion is configured to at least partially form a base portion of the article. The method may further include knitting a second portion of the knitted component, wherein the second portion is configured to at least partially form a strap of the article, where the strap includes a first edge secured to the base portion. The method may further include releasing the first edge of the strap from the base portion.

A pocket may be located between the strap and the base portion and may be accessible from the first edge of the strap after the step of releasing the first edge of the strap from the base portion.

The first portion of the knitted component and the second portion of the knitted component may be knitted as an integral one-piece element.

The method may further include the step of knitting a third portion of the knitted component, wherein the third portion of the knitted component is secured to the first portion of the knitted component.

The first and second portions of the knitted component may be knitted on a first needle bed, and the third portion of the knitted component may be formed on a second needle bed.

The first portion of the knitted component may be knitted on a first needle bed, and the second portion of the knitted component may be knitted on a second needle bed.

The step of releasing the first edge of the strap from the base portion may include releasing a releasable yarn.

The releasable yarn may include a thermoplastic polymer material.

In another aspect, an upper for an article of footwear may include a knitted component having a first portion and a second portion. The first portion of the knitted component may at least partially form a foot-receiving portion of the upper. The second portion of the knitted component may at least partially form a strap of the upper, where the strap includes a first edge and a second edge secured to the first portion of the knitted component. The strap may include a third edge that extends from the first edge to the second edge.

The third edge may be a free edge.

The upper of claim 9, wherein the strap includes a fourth edge that extends from the first edge to the second edge.

The length of the strap may extend from a lateral side of the upper to a medial side of the upper and over a throat area of the upper.

The first portion of the knitted component and the second portion of the knitted component may be integral.

The knitted component may include a first layer including the first portion and a second layer including the second portion.

The knitted component may further include a third layer, where the first and second layers are formed on a first needle bed of a knitting machine and the third layer is formed on a second bed of the knitting machine.

The upper may further include at least one tension element located in a pocket defined between the foot-receiving portion of the upper and the strap of the upper.

The tension element may be inserted within the knitted component, and slack of the tension element may be pulled into the pocket to form at least one loop.

The tension element may be associated with a fastening system, and the strap may cover at least a portion of the fastening system.

The fastening system may include a lace, and the strap may be configured to cover at least a portion of the lace.

The first edge may be located on a medial side of the upper, and the second edge may be located on a lateral side of the upper.

The strap may extend over a throat area of the upper.

In another aspect, an article may include a knitted component with a first portion and a second portion, where a pocket is located between the first portion and the second portion. The first potion may have a releasable edge secured to the first portion and configured to release from the first portion. The releasable edge may have at least one releasable yarn.

The releasable yarn may be configured to react to a stimulus.

The releasable yarn may include a thermoplastic polymer material.

The releasable yarn may have a lower tensile strength than a second yarn of the knitted component;

The knitted component may include a third portion, the third portion being secured to the first portion of the knitted component.

At least two of the first, second, and third portions of the knitted component may be substantially formed on one needle bed.

The article may form an upper for an article of footwear.

The second portion of the knitted component may include a second edge that is configured to remain permanently secured to the first portion of the knitted component.

In another aspect, an article may include a first knit layer, a second knit layer secured to the first knit layer, and a third knit layer secured to the first knit layer. At least two of the first, second, and third knit layers may be formed on a first needle bed of a knitting machine. The first, second, and third knit layers may be integral.

The first and second knit layers may be formed on the first needle bed, and the third knit layer may be formed on a second needle bed of the knitting machine.

The article may also include a fourth knit layer, the fourth knit layer being integral with the first, second, and third knit layers.

The fourth layer may be formed on the second needle bed of the knitting machine.

The first layer may at least partially form a base portion of the article, and the second layer may form a strap secured to the base such that a pocket is formed between the strap and the base.

The second knit layer may include at least one free edge.

The third layer may at least partially form the base.

In another aspect, an upper for an article of footwear may include a textile component having a first portion and a second portion. The first portion of the knitted component may at least partially form a foot-receiving portion of the upper. The second portion of the textile component may at least partially form a strap of the upper, where the strap includes a first edge and a second edge secured to the first portion of the knitted component. The strap may include a third edge that extends from the first edge to the second edge.

DETAILED DESCRIPTION

Figure 1:
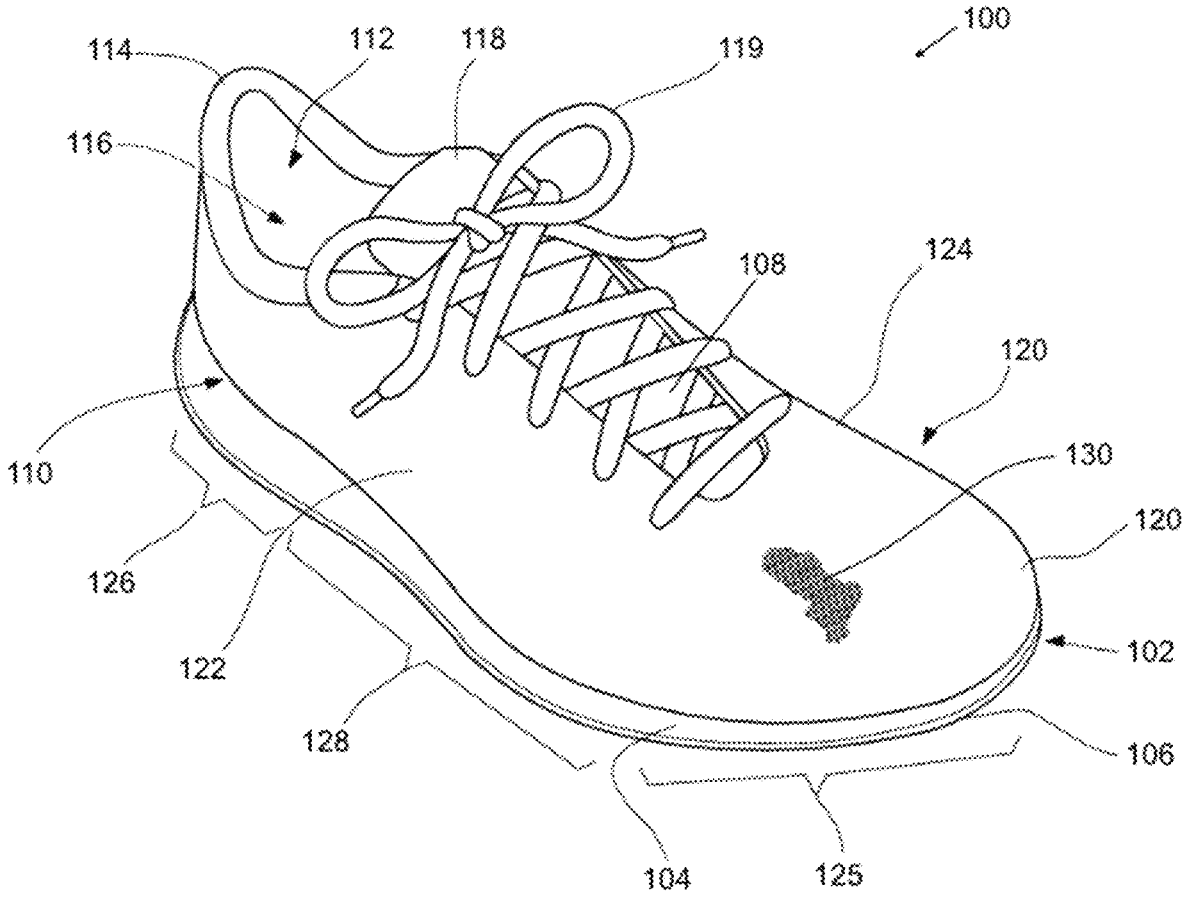
FIG. 1 shows an article of footwear with an upper formed of a knitted component.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

Certain aspects of the present disclosure relate to uppers configured for use in an article of footwear and/or other articles, such as article of apparel. When referring to articles of footwear, the uppers may be used in connection with any type of footwear. Illustrative, non-limiting examples of articles of footwear include a basketball shoe, a biking shoe, a cross-training shoe, a global football (soccer) shoe, an American football shoe, a bowling shoe, a golf shoe, a hiking shoe, a ski or snowboarding boot, a tennis shoe, a running shoe, and a walking shoe. The uppers may also be incorporated into non-athletic shoes, such as dress shoes, loafers, and sandals.

With respect to FIG. 1, an article of footwear 100 is generally depicted as comprising a sole 102 and an upper 120. The upper 120 includes a lateral side 122, a medial side 124, and a heel region 126. The area of the shoe where the sole 102 joins the outer edge of the upper 120 may be referred to as the biteline 110. The upper 120 may be joined to the sole 102 in a fixed manner using any suitable technique, such as through the use of an adhesive, by sewing, etc.

In some embodiments, the sole 102 includes a midsole 104 and an outsole 106. The article of footwear may additionally comprise a throat 108 and an ankle opening 112, which is surrounded by a collar 114 and leads to a void 116. The upper 120 may define at least a portion of the void 116 of the article of footwear that is configured to accommodate the foot of a person. The throat 108 is disposed in a mid-foot region 128 of the upper 120. The mid-foot region 128 is generally a section of the upper 120 located between the heel region 126 and a toe portion 125.

In FIG. 1, a tongue 118 is disposed in the throat 108 of the article of footwear 100, but the tongue 118 is an optional component, as is the lace 119. Although the tongue 118 depicted in FIG. 1 is a traditional tongue, the tongue 118, if included, may be any type of tongue, such as a gusseted tongue or a burrito tongue. If a tongue is not included, the lateral and medial sides of the throat 108 may be joined together, for example.

The upper 120 may be formed at least partially of a knitted component 130 (and, as depicted, the upper 120 may be substantially or entirely formed of the knitted component 130). While the upper 120 is herein described as including the knitted component 130, it alternatively or additionally could include a textile component formed by a process other than knitting (e.g., weaving). The knitted component 130 may be a single layer or multi-layer knitted component with a first side and a second side. The first side may define the outer surface of the upper 120 and the second side may define a surface facing the void 116 of the article of footwear.

The knitted component 130 may have two or more regions that exhibit different properties. For example, one region may be relatively elastic, and another region may be relatively inelastic. In one exemplary embodiment, for example, the throat area 208 shown in FIG. 2A may have a relatively high elasticity as compared to the rest of the upper 220. These characteristics may be accomplished by selecting a particular single layer or multi-layer knit structure (e.g., a ribbed knit structure), by varying the size and tension of the knit structure, by using one or more yarns formed of a particular material (e.g., an elastic material such as spandex), by selecting yarns of a particular size (e.g., denier), or any suitable combination thereof. Advantageously, providing an upper 220 with a relatively elastic throat area 208 may be desirable when utilizing a fastening system in or adjacent to the throat area 208 to allow a user to adjust the fit of the upper 220 around the user's foot.

Figure 2A:
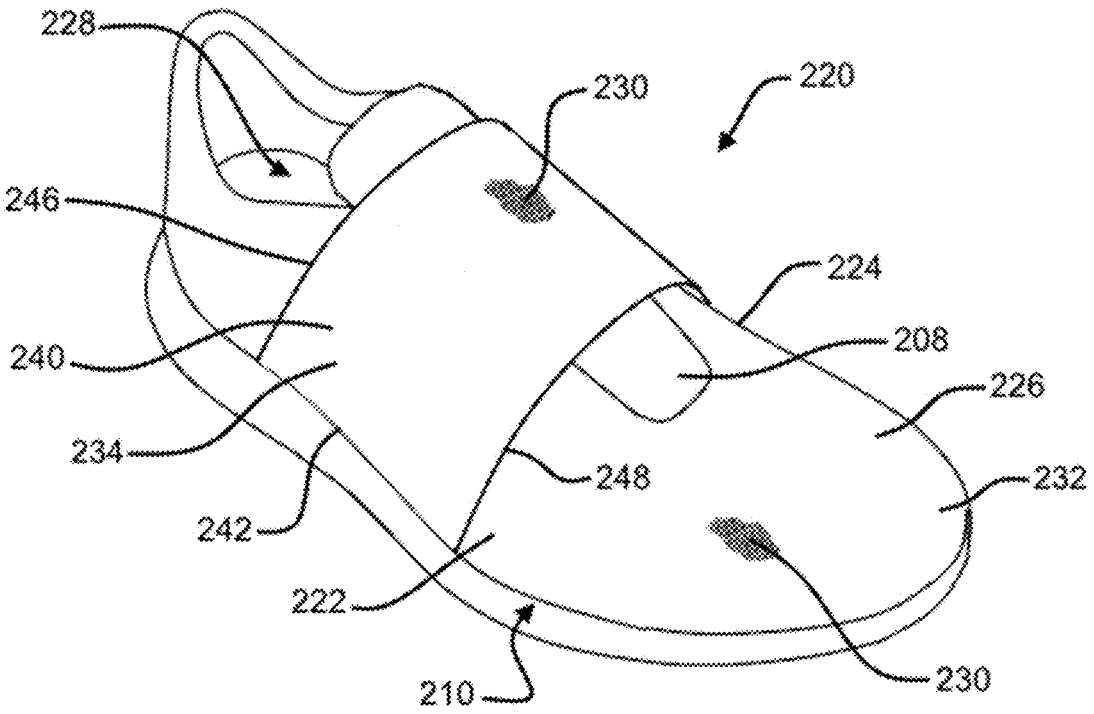
FIG. 2A shows an article of footwear with an upper including a foot-receiving portion and a strap.
Figure 2B:
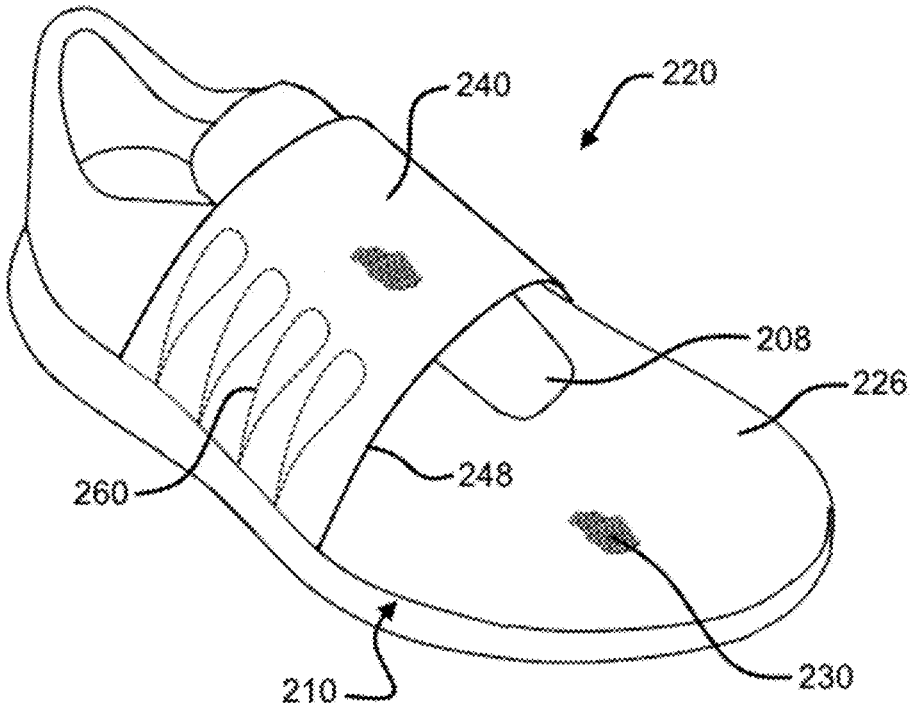
FIG. 2B shows an article of footwear with an upper including a foot-receiving portion, a strap, and a plurality of tensile elements.
Figure 2C:
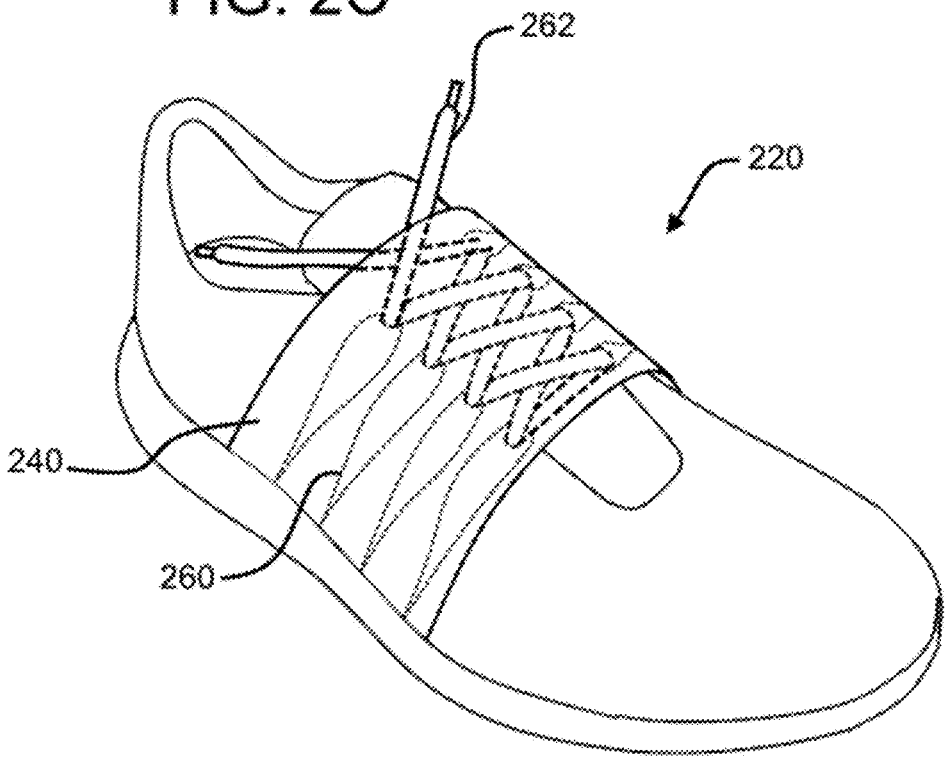
FIG. 2C shows an article of footwear with an upper including a foot-receiving portion, a strap, a plurality of tensile elements, and a lace.

In some embodiments, the upper 220 may include a foot-receiving portion (herein referred to as "base portion 226") and at least one strap extending from the base portion 226, depicted as the strap 240 in FIGS. 2A-C. Referring to FIG. 2A, the strap 240 may extend from the medial side 224 of the upper 220 to the lateral side 222 of the upper 220, though it is contemplated that the strap 240 may extend in any other direction. As shown, the strap 240 may include a first edge 242 which is secured to the base portion 226 in a vamp region on the lateral side 222 of the upper 220 (e.g., optionally near the biteline 210 as depicted in FIG. 2A). The strap 240 may extend over the throat area 208 of the upper 220 and to a second edge that is secured to the upper 220 on the medial side 224. The second edge is blocked from view in FIGS. 2A-C (see second edge 344 in FIGS. 3A-C). As shown in the depicted embodiment, the third edge 246 and the fourth edge 248 may freely extend (i.e., extend in an unsecured manner with respect to the first portion 232) along the length of the strap from the first edge 242 to the above-described second edge. While the strap 240 is shown as being generally rectangular and is described as having four edges, the strap 240 is not limited to any particular shape or any particular number of edges. Further, any number of the edges of the strap 240 may be secured to the base portion 226 of the upper 220. In some embodiments, for example, only one edge (e.g., the first edge 242) may be secured such that the strap 240 includes a free end, which may allow a person to selectively wrap the strap 240 around his or her foot, ankle, and/or leg.

The upper 220 may be at least partially formed of (and in some cases fully formed of) the knitted component 230. The knitted component 230 may include a first portion 232 at least partially forming the base portion 226 of the upper 220 and a second portion 234 at least partially forming the strap 240. The knitted component 230 may be formed as an integral one-piece element during a knitting process such that the base portion 226 and the strap 240 have knit structures that are integral and/or share at least one common yarn and/or course. That is, a single knitting process (e.g., on a knitting machine) may substantially form the knit structure of the first and second portions of the knitted component 230 without the need for significant post-knitting processes or steps. Advantageously, this may reduce or eliminate the need for post-knit formed seams associated with the upper 220, which are typically associated with susceptibility for structural failure. Alternatively, the base portion 226 and the strap 240 may be formed separately (e.g., through two or more separate knitting processes) and then secured together by sewing, by using an adhesive, or by another suitable securing method.

The strap 240 may provide several advantages. For example, the strap 240 may be configured with a particular tension such that when the article of footwear is being worn, the tightness of the upper 220 in selected regions associated with the strap 240 is increased, which may produce a comfortable, secure fit and may be optimal for certain activities. The additional tightness provided by the strap 240 may reduce or eliminate the need for a separate fastening system (e.g., a system incorporating a lace) and/or may enhance the effectiveness of a fastening system. For example, the strap 240 may provide enough tension alone such that no traditional laces are necessary to provide a sufficiently tight fit. Traditional laces (or another fastening system) may still be included, and its effect may be amplified by the tension of the strap 240.

For example, referring to FIG. 2B, a fastening system may include one or more tension elements 260 that may extend towards the throat area 208 of the upper 220. The tension elements 260 may be inlaid within either the base portion 226 or the strap 240 (or both) during the knitting process of the knitted component 230, though this is not necessary. In some embodiments, and as described in more detail below, the tension elements 260 may initially be located external to a pocket 241 formed by the strap 240 during at least one step of the manufacturing process of the upper 220 and then later maneuvered into the pocket 241 between the strap 240 and the base portion 226. As shown in FIG. 2C, the tension elements 260 may be configured to interact with a lace 262 of the fastening system (and/or, for example, a strap, a ratchet system, or another suitable device for tightening and/or loosening the upper). The strap 240 may provide a cover over the lace 262, which may be advantageous for a variety of reasons. For example, in a working environment, the strap 240 may provide protection of the lace 262 and may prevent the lace 262 from snagging on objects external to the article of footwear. In an athletic environment, for example, the strap 240 may cover the lace 262 to provide a smooth outer surface of the upper 220 and to prevent the fastening system from interfering with certain functions, such as kicking a soccer ball. These same advantages apply with respect to the tension elements 260, which may be susceptible to snagging, may provide an uneven surface, etc. if not covered by the strap 240.

Figure 3A:
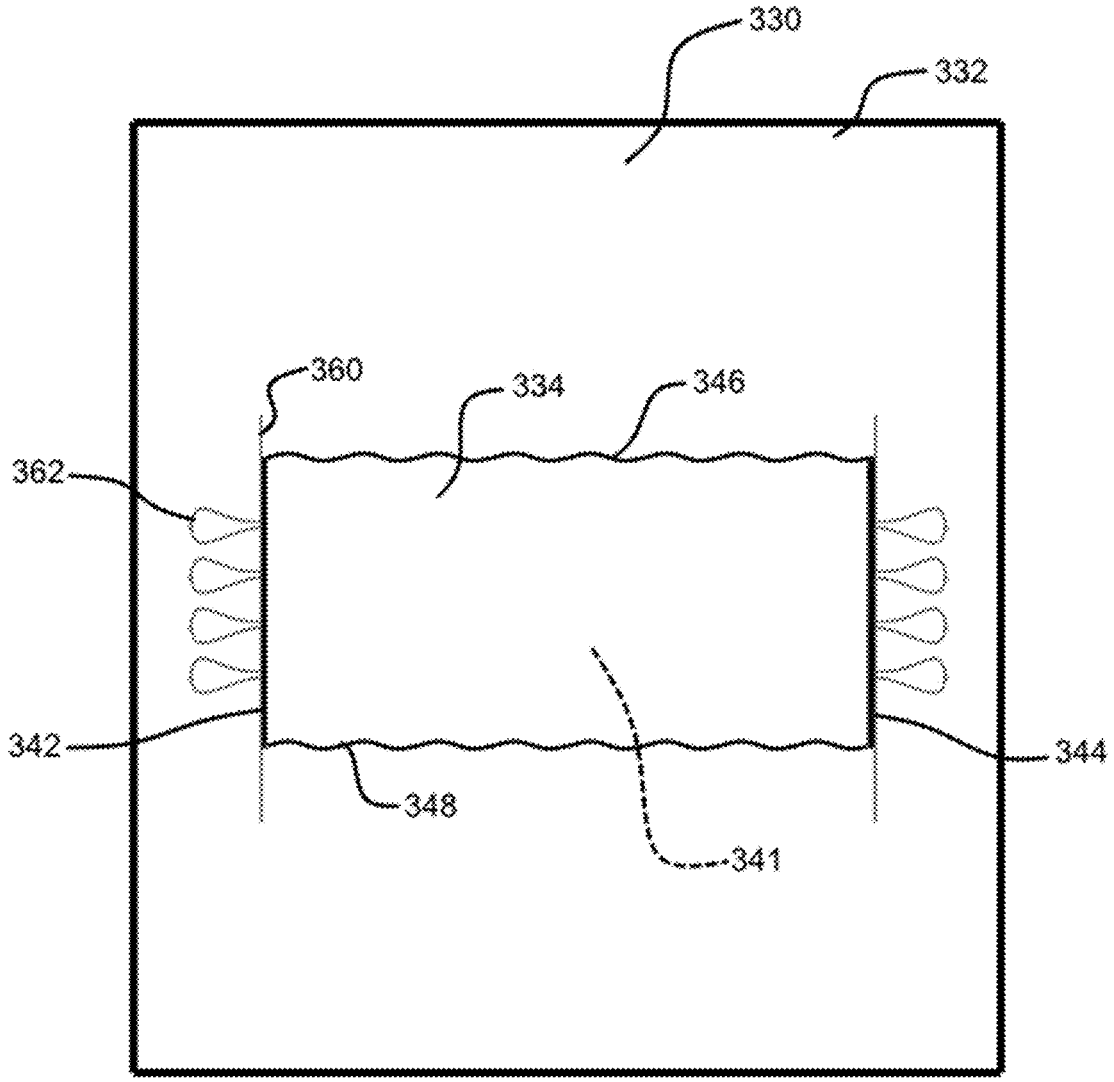
FIG. 3A shows a knitted component with a first layer forming a first portion, a second layer forming a second portion, two releasable edges securing the first portion and the second portion, and two tension elements forming a plurality of loops.

FIG. 3A shows a knitted component 330, which may be incorporated into an upper of an article of footwear as described above. As shown, the knitted component 330 may be formed as an integral one-piece element during a knitting process, such as a weft knitting process (e.g., with a flat knitting machine or circular knitting machine), a warp knitting process, or any other suitable knitting process. The knitted component 330 may have a first portion 332, which may be configured to at least partially form a foot-receiving portion (e.g., base portion 226 of FIG. 2A) of an upper. The knitted component 330 may further comprise a second portion 334, which may be configured to form at least a portion of a strap (e.g., strap 240 of FIG. 2A) of an upper. The first portion 332 and the second portion 334 may be formed as an integral one-piece element such that the first portion 332 and the second portion 334 share at least one common yarn.

As shown in FIG. 3A, the knitted component 330 may be formed as a multi-layer knitted component. FIG. 3A shows one embodiment of a knitted component 330 as it may appear after a knitting process. The knitted component may have a first knit layer forming the first portion 332 and a second knit layer forming the second portion 334. A pocket 341 may be formed between the first portion 332 and the second portion 334. The first and second knit layers may have different characteristics. For example, the second portion 334 may be more elastic than the first portion 332. In some embodiments, the first layer may be substantially formed on a first needle bed (e.g., a back needle bed) of a flat knitting machine, while the second layer may be substantially formed on a second needle bed (e.g., a front needle bed) of a flat knitting machine.

Figure 4A:
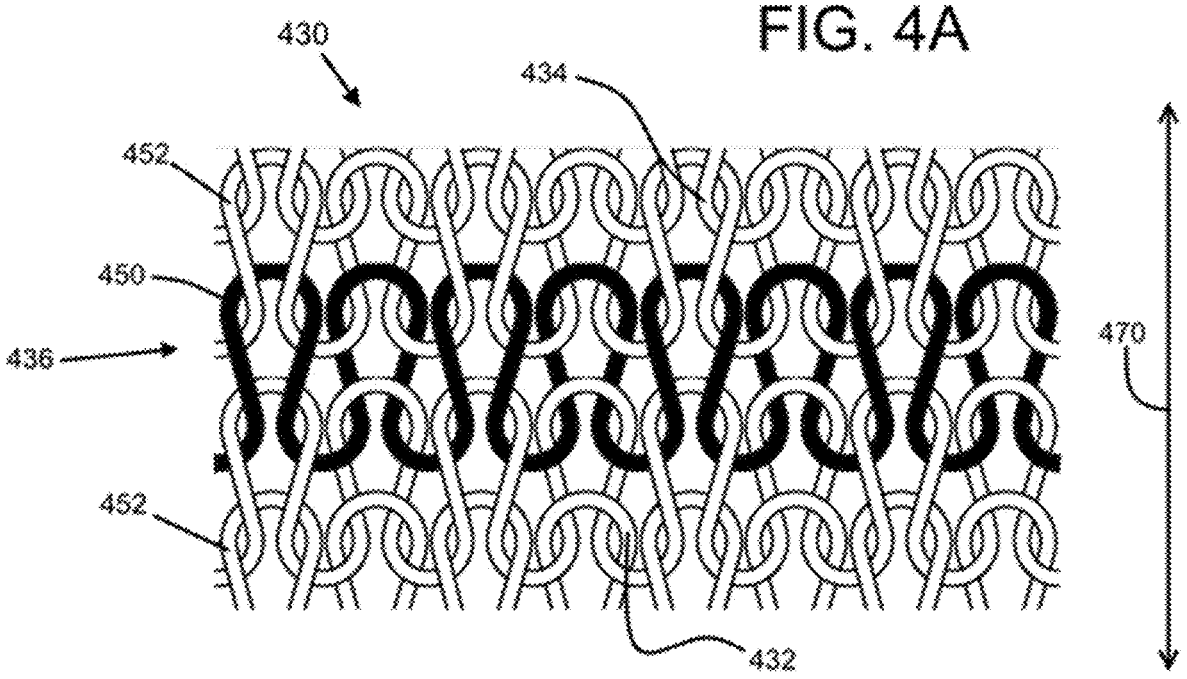
FIG. 4A shows a knitted component including a releasable yarn.
Figure 4B:
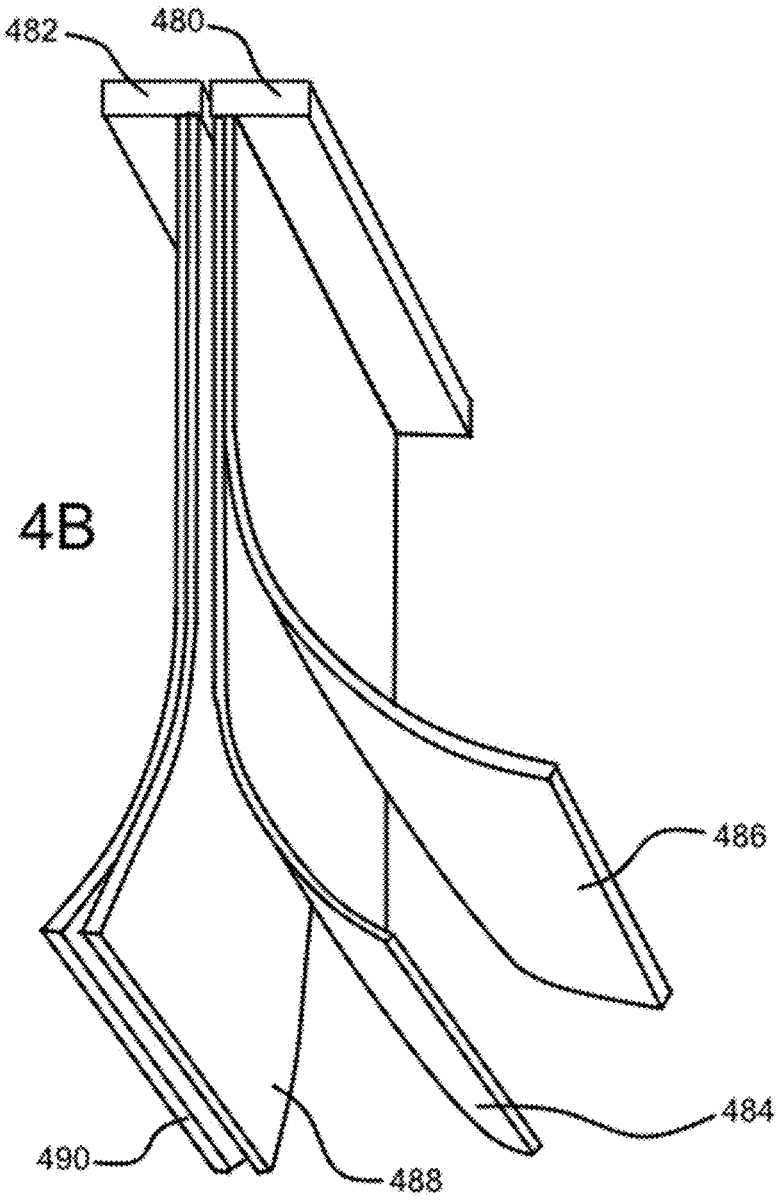
FIG. 4B shows an illustration of a knitting technique for knitting multiple layers on a knitting machine.

In some embodiments, both the first and second layers may be formed on only one needle bed. This technique is illustrated in FIG. 4B. As shown in FIG. 4B, a knitting machine may have a series of needles 480 associated with a first needle bed and a series of needles 482 associated with a second needle bed. A portion of the first needles 480 may form the first layer 484, and the remaining first needles 480 (which are unoccupied by the first layer 484) may operate to form the second layer 486. The result may be two layers that are approximately half-gauge when compared to a fabric utilizing all of the first needles 480. Advantageously, this may allow at least one additional layer (and potentially multiple additional layers) to be formed separately on the second needle bed. For example, as depicted in FIG. 4B, at least one layer may additionally be formed on the needles 482 (here depicted as layers 488 and 490). It is contemplated that more than two layers may be formed on a single needle bed. While in FIG. 4B, the layers are shown as unsecured, the edges of two of more of the layers may be secured in practice.

In one exemplary embodiment (referring back to FIG. 3A), a first needle bed of a flat knitting machine may form the first layer of the knitted component 330, where the first layer corresponds to the first portion 332 (which as described herein may be configured to a form side of a base portion 226 (FIG. 2A) associated with the dorsal surface of the foot). In this embodiment, the second layer of the knitted component 330 may also be formed on the first needle bed of the flat knitting machine, where the second layer corresponds to the second portion 334 for forming the strap 240 (FIG. 2A). A third layer may be formed on the second needle bed, and may correspond to the side of the base portion 226 (FIG. 2A) associated with the plantar surface of the foot. Finally, a fourth layer, also associated with the plantar surface of the foot, may additionally be formed on the second needle bed. Advantageously, and referring to FIG. 2A, this may form a base portion 226 that substantially surrounds the void 228 of the article of footwear, which may advantageously provide a particularly comfortable and secure fit around a foot optimal for certain activities (like athletic activities). This advantage may alternatively be accomplished with only two layers. For example, a layer corresponding to the base portion 226 of the article of footwear may be large enough to be wrapped and shaped substantially around the void 228. A similar (or identical) knitting process may also be used to form an article other than an upper (e.g., an article of apparel).

Referring to FIG. 3A, in some embodiments, the edges of the second portion 334 (e.g., edges 342, 344, 346, and 348) may be secured to the first portion 332 during and immediately after the knitted component 330 is formed by a knitting process. In other words, the pocket 341 may be substantially inaccessible without penetrating the knit structure of either the first portion 332 or the second portion 334. In some embodiments, the knitted component 330 may include at least one yarn (here referred to as a "releasable yarn") that is configured to release the first portion 332 from the second portion 334 at one or more edges.

For example, as depicted in FIG. 3A, the first edge 342 and the second edge 344 may correspond to edges of a strap that are intended to be permanently secured to a base portion of an upper (for example, edge 242 as shown in FIGS. 2A-C). On the other hand, at least one edge, and in this case the third edge 346 and fourth edge 348, may be configured to be a free edge that has at least a section that freely extends along a length the strap (in a manner unsecured to a base portion). However, while it may be desirable for the third edge 346 and the fourth edge 348 to be free edges that are unsecured to the first portion 332 when the knitted component 330 is incorporated into the article of footwear in its finality, it may be advantageous for the third edge 346 and/or the fourth edge 348 to be secured to the first portion 332 during certain steps of the manufacturing process. For example, free edges may be susceptible to snagging on machinery used during the manufacturing process (including the knitting process). Further, because in some instances the first portion 332 and the second portion 334 may have different characteristics (e.g., different tension, stretchability, or resting length), keeping all of the edges of the second portion 334 secured to the first portion 332 may prevent unwanted deformation (e.g., bowing of the strap 340 away from the first portion 332) of the knitted component during the manufacturing process, which may interrupt and/or complicate certain manufacturing steps.

Accordingly, certain edges, including the third edge 346 and the fourth edge 348 depicted in FIG. 3A, may include a releasable yarn. Herein, an edge will be said to "include" the releasable yarn when the releasable yarn forms a portion of the edge and/or when a releasable yarn is incorporated into the knit structure adjacent to the edge when the edge is in a secured and/or unsecured state. FIG. 4A depicts one embodiment of a releasable yarn 450, which is included within the knitted component 430. A releasable edge 436 of FIG. 4A may correspond with a releasable edge of a knitted component for incorporation into an upper, such as the edge 346 of FIG. 3A. For purposes of illustration, the knitted component 430 is shown with only one layer in FIG. 4A, but it should be appreciated that another layer may be provided, for example beneath second portion 434 (which may form a continued knit structure of the first portion 432). Though only one releasable yarn 450 is shown, a series of any number of releasable yarns may be included. In some embodiments, the releasable edge 436 may not be visually apparent prior to its release.

The releasable yarn 450 may comprise a material that reacts in response to a stimulus (e.g., temperature, moisture, electrical current, or exposure to a certain chemical). The stimulus may weaken and/or dissolve the releasable yarn 450 such that the releasable edge 436 may be released from the first portion 432 of the knitted component 430 in a relatively easy and efficient manner. For example, the releasable yarn 450 may be formed substantially of a thermoplastic polymer material (e.g., a polyurethane, a polyamide, a polyolefin, and/or a nylon) that transitions from a solid state to a softened or liquid state when subjected to certain temperatures at or above its melting point and then transitions back to the solid state when cooled. When subjected to a relatively high temperature, the releasable yarn 450 may therefore be weakened such that the releasable edge 436 of the second portion 434 may be released from the first portion 432 with an application of a relatively low amount of tension in the direction indicated by arrow 470. The releasable yarn 450 may break or otherwise free the releasable edge 436 from the first portion 432 when subjected to this tension. Some of the thermoplastic polymer material may remain at the edge 436 and may then cool and harden to preserve the integrity of the edge 436 (and/or the area of the first portion 432 where the edge 436 was formerly secured).

In another embodiment, the releasable yarn 450 may be made of a material that is soluble in water, such as a water-soluble synthetic polymer (e.g., polyvinyl alcohol). To release the releasable edge 436, the releasable yarn 450 may be submerged in water or otherwise moisturized. The dissolution of the releasable yarn 450 may weaken it and/or remove its structure to the extent that the releasable edge 436 can be pulled away from the first portion 432 of the knitted component 430 with relatively low force. The releasable yarn 450 may be formed of a material that is soluble in a fluid besides water. Further, it is contemplated that the releasable yarn 450 is not configured to react to a stimulus, but alternatively or additionally it may simply be weaker (e.g. it may have a lower tensile strength measured as the maximum amount of tension that it can withstand before breaking) than the yarns 452 forming the first portion 432 and/or second portion 434 of the knitted component 430 such that the releasable yarn 450 breaks under a certain tension while the yarns 452 are sufficiently strong to remain intact under that same tension. The yarns 452 do not all need to be made of the same material (and may vary between portions of the knitted component 430 or different locations within the same portion). In exemplary embodiments, the yarns 452 may be formed of polyester, but any other suitable material or a combination of suitable materials may be used.

Figure 3B:
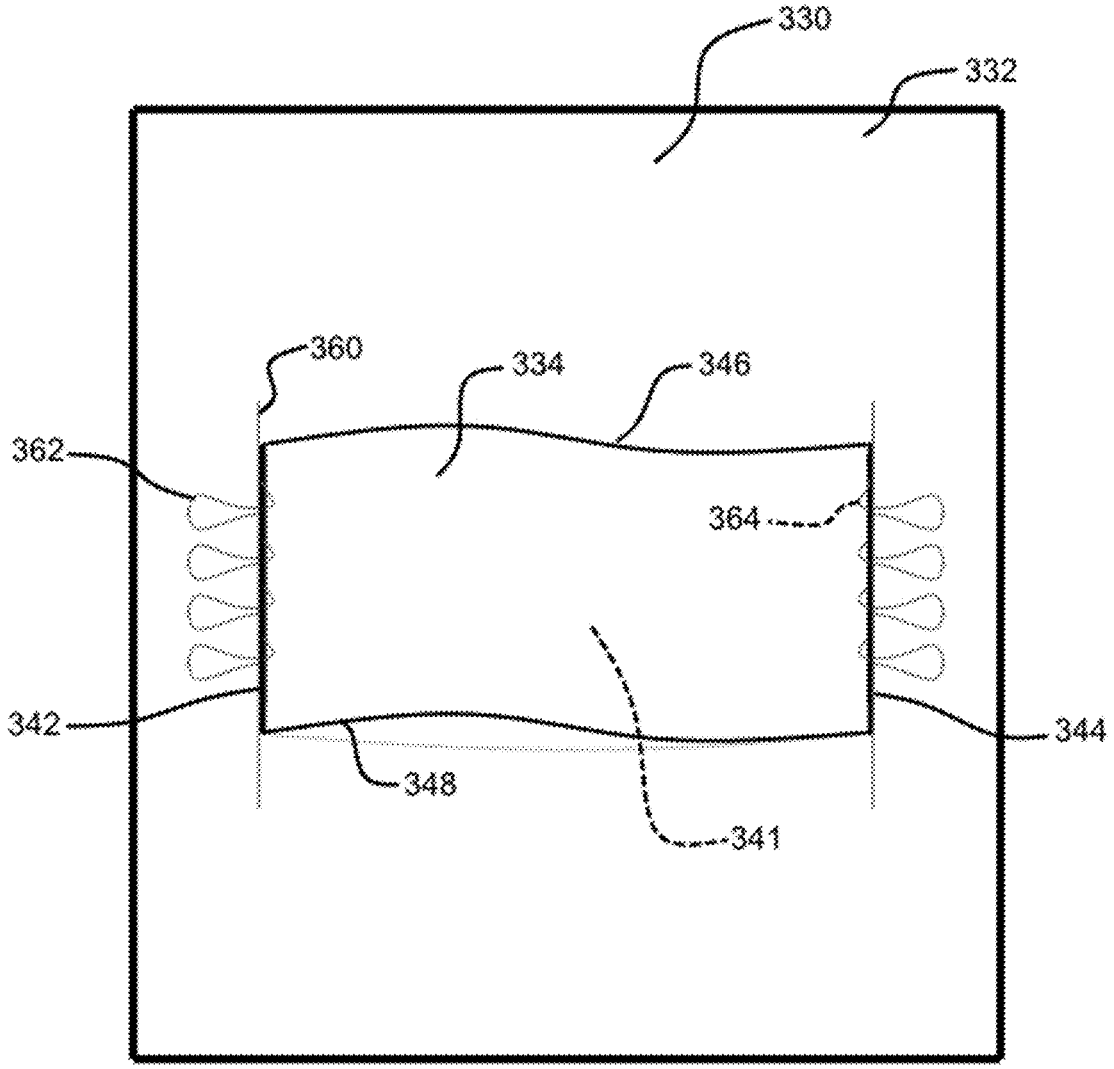
FIG. 3B shows the knitted component of FIG. 3A, where the releasable edges have been released.

FIG. 3B shows the knitted component 330 of FIG. 3A, where the third edge 346 and the fourth edge 348 of the second portion 334 have been released from the first portion 332 to become free edges, while the depicted first edge 342 and second edge 344 are still secured to the first portion 332. The area 349 indicates the previous attachment of fourth edge 348, but the area 349 may or may not be visually apparent in practice. Further, the strap 340 is depicted as being relatively loose with respect to the first portion 332, but in practice it may be relatively taught. The resulting structure of the knitted component 330 may include a strap 340 extending from the first portion 332. As shown, the strap 340 is shown as formed prior to the knitted component 330 being shaped into the shape of an upper, but the step of releasing a releasable edge may occur at any time during the manufacturing of an article of footwear. The first edge 342 and the second edge 344, while still secured, are not ruled out from including a releasable yarn even if they are not intended to ever be released.

While herein, a strap of an upper is typically described as having two free edges, it is contemplated that the strap could have only one free edge (e.g., an edge with a section that is not secured to another portion) such that the pocket 341 beneath the strap 340 is generally accessible through only one side. For example, referring to FIG. 3A, in an alternative embodiment, only the fourth edge 348 may be configured to be a releasable edge (and eventually a free edge), while the first edge 342, the second edge 344, and the third edge 346 may be intended to remain secured to the first portion 332 of the knitted component 330. The resulting strap 340 and the first portion 332 may form a pocket that is generally accessible from (i.e., beneath) the fourth edge 348 once the fourth edge 348 is released. Further, in this embodiment and in some other embodiments, one or more additional point of access (e.g., openings or holes) to the pocket may be formed. For example, holes or openings may be formed in the strap 340 and/or the first portion 332. Further, one or more of the edges 342, 344, 346, and 348 may be only partially releasable (e.g., a portion of the length of the edge is configured to be released from the first portion 332 while the remaining portion of the length is not).

Still referring to FIG. 3A, in some embodiments, the knitted component may include one or more yarns, strands, or other objects that are at least partially inlaid or otherwise inserted within the knit structure of the knitted component 330 during or after the knitting process, herein referred to as "tensile strands" (not shown). The tensile strands may be substantially inelastic so as to have a substantially fixed length. The tensile strands may extend through a plurality of courses of the knitted component or through a passage within the knitted component and may limit the stretch of the knitted component in at least one direction. For example, the tensile strands may extend through the first portion 332 of the knitted component 330 approximately from an area corresponding to a biteline of the associated upper to a throat area of the associated upper to thereby limit the stretch of the upper in the lateral direction.

Additionally or alternatively, in some embodiments, a yarn, strand, or other object may be inlaid vertically or otherwise vertically inserted within at least a portion of the knit structure of the knitted component 330. As shown in FIG. 3A, for example, two strands (herein depicted as the tension elements 360) may be vertically inserted within or otherwise secured to at least a portion of the knitted component 330. The attachment may be accomplished by inlaying the tension elements 360 during the knitting process (e.g., in the vertical direction with respect to the needle bed(s) of the knitting machine, though it is also contemplated that a horizontal inlaying procedure could be used), by feeding the tension elements 360 through the knit structure of the knitted component 330 after forming the knit structure of the knitted component 330, by sewing, by using an adhesive, or by any other suitable attachment method. While not required, it may be advantageous to insert the tension elements 360 at or near an edge (such as the edge 342 and the edge 344) such that the tension elements 360 can later be maneuvered into the pocket 341, as described below.

In FIG. 3A, the tension elements 360 are depicted with a substantial amount of slack. The slack may be used to form one or more loops 362. For simplicity of installation and efficiency, the loops 362 may extend outside of and away from the pocket 341 prior to the release of any releasable edges of the second portion 334 of the knitted component 330. After at least one edge is released, as shown in FIG. 3B, the tension elements 360 may be more easily accessible from within the pocket 341. Accordingly, as shown in FIG. 3B, the slack forming the loops 362 may be accessed from between the strap 340 and the first portion 332 (e.g., one may be capable of accessing the pocket 341 to pull on the slack portion 364).

Figure 3C:
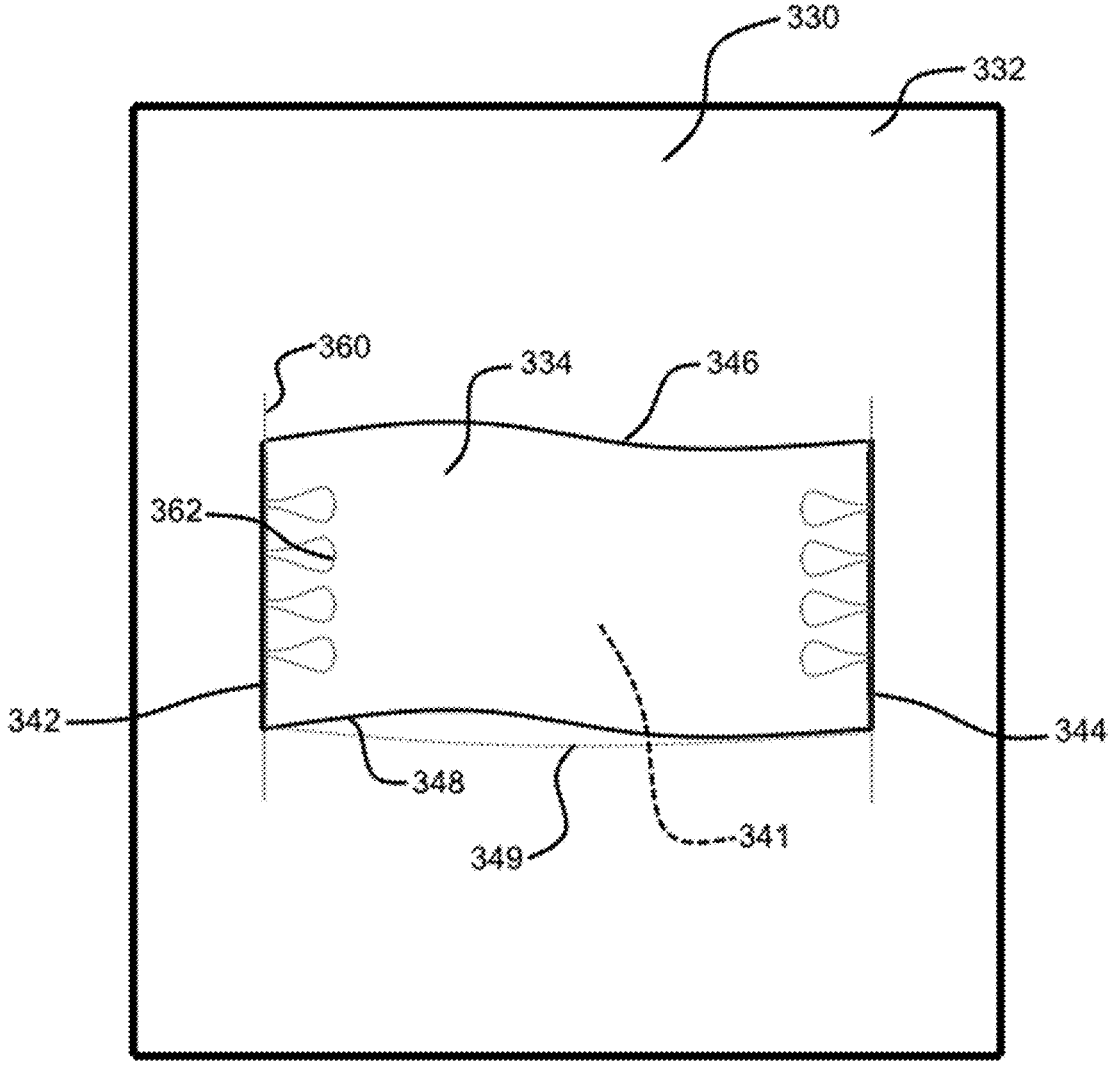
FIG. 3C shows the knitted component of FIGS. 3A-B, where the tension elements have been maneuvered into a pocket between the first portion and the second portion.

In some embodiments, and referring to FIG. 3C, it may be desirable to substantially maneuver most of or all of the slack of the tension elements 360 such that the loops 362 are located in the pocket 341, as shown. Certain portions of the tension elements 360, including the portions at the edges 342 and 344 and between the loops 362, may be sewn or otherwise locked in place to thereby finalize the size of the loops 362. Further, a portion of one of more of the loops 362 may be sewn or otherwise secured at a location beneath the strap 340, such as at location 366, which may be advantageous for ensuring that one or more of the loops 362 remain in a desired location and orientation during the manufacturing process and/or during use of the article of footwear. If the knitted component 330 is then used to form an upper of an article of footwear, the tension elements 360 may be incorporated into a system for tightening an upper of the article of footwear around the foot of a user, for example. This exemplary feature is shown by the tension elements 260 of FIGS. 2A-C. In other embodiments, the knitted component 330 with the tension elements 360 may be configured for use in another function (e.g., to provide tension elements in an area of an article of apparel).

Figure 5:
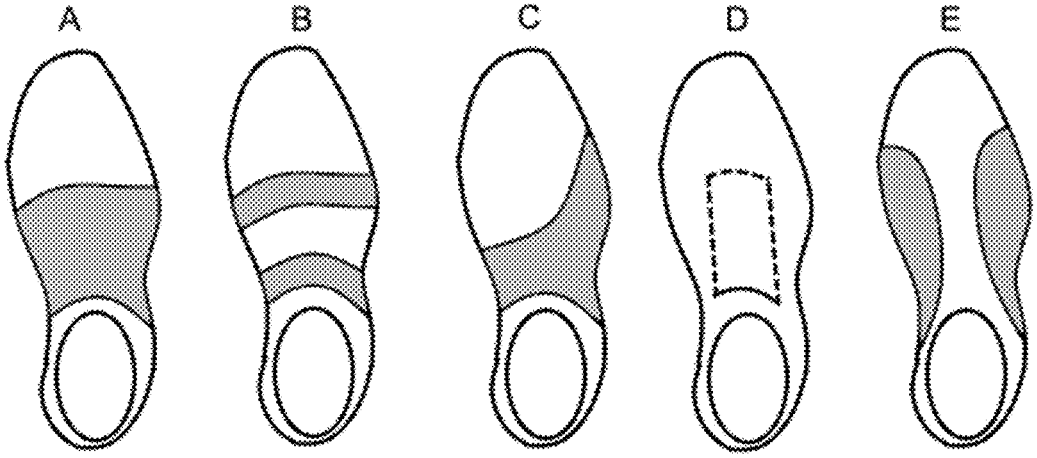
FIG. 5 shows a series of examples of uppers with straps having various shapes.

An upper (or other article) with a strap as described herein is not limited to any particular design. FIG. 5 shows five embodiments of uppers for illustrative purposes, though any other suitable embodiment that is not shown may also be used. Upper A, for example, shows a strap (depicted as shaded) that is orientated horizontally across the instep similar to the embodiment described above with respect to FIGS. 2A-C. As described above, a pocket may be formed between the strap and a base portion of the upper, and the strap may have one or more free edges such that the pocket is accessible. Upper B similarly has a first strap that is oriented horizontally across the instep and also includes a second strap oriented horizontally across the instep. It is also contemplated that more than two straps may be included.

Upper C includes a strap that is similar to the strap of upper A, but the strap of upper C is biased towards the lateral side of the upper. The opposite (e.g., a strap that is biased towards the medial side of the upper) is also contemplated. Upper D includes a strap that extends from the side of the base portion within the void of the article of footwear. A pocket formed between in accordance with upper D may be accessible from inside the void. This may be advantageous where it is desirable to hold an object within or adjacent to the void (e.g., an object such as a device for counting steps). Upper E includes two straps that are oriented vertically on the medial and lateral sides of the upper, respectively.

While the embodiments above generally focus on an upper for an article of footwear, the aspects described herein are also applicable to other devices, such as other wearable devices (herein referred to as "apparel"). For example, referring to FIGS. 6A-B, the aspects described above may be applied to a sleeve that may be worn around the arm of a person. In other embodiments, the aspects described herein may be applied to other articles of apparel, including shirts, pants, socks, footwear, jackets and other outerwear, briefs and other undergarments, hats and other headwear, and the like. It is also contemplated that the above described aspects could be applied to any other object incorporating a knitted component or other textile component.

Figure 6A:
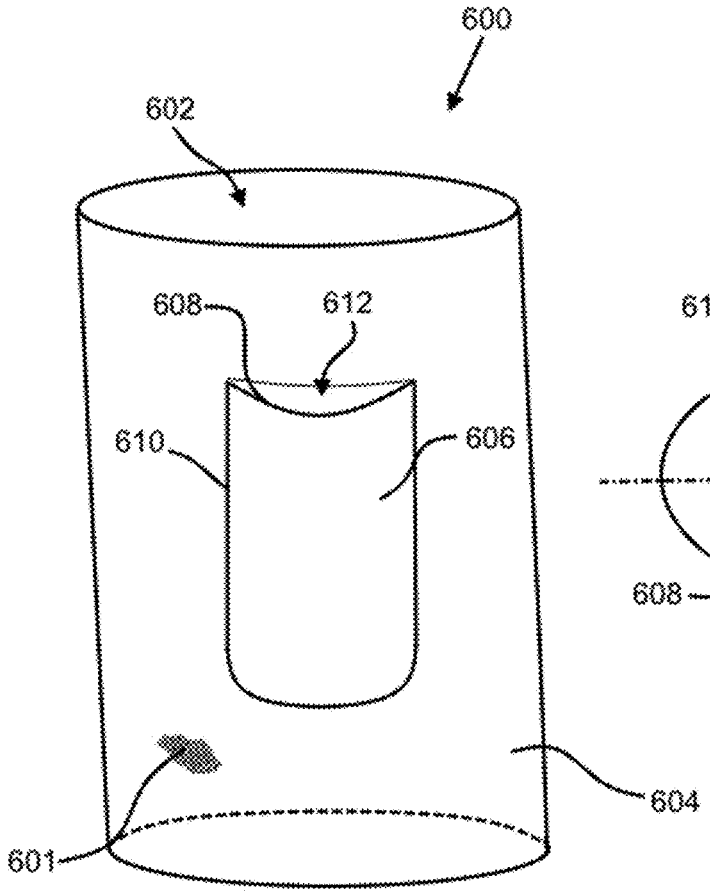
FIG. 6A shows a front view of an article having a strap forming a pocket.

The sleeve 600 of FIG. 6A may be partially or substantially formed of a knitted component 601. The sleeve 600 may include a void 602 configured for receiving the arm of a person. A base portion 604 of the sleeve 600, which may be substantially formed of the knitted component 601, may include an inherent elasticity (e.g., with a ribbed knit structure) such that it comfortably and securely fits around the arm of the person. The sleeve 600 may further include a strap 606 that extends from the base portion 604 (similar to as described above with respect to the strap 240 of FIGS. 2A-C). The strap 606 may be integral with the base portion 604. The strap 606 may include a free edge 608 such that a pocket 612 is formed between the strap 606 and the base portion 604. In other embodiments, the strap 606 may include more than one free edge or zero free edges. The pocket 612 may be configured to hold an object, such as a cellular phone, a music player, a wallet, money, or the like.

As described above, the free edge 608 may initially be a releasable edge secured to the base portion 604 at some point during the manufacturing process (such as immediately after a knitting process, if applicable). This may be advantageous for preventing snagging of the edge 608 and/or preventing warping of the sleeve 600 during the manufacturing process, for example. Other edges, such as the depicted edge 610, may remain secured to the base portion 604 throughout the manufacturing process and the life of the product. More than one releasable edge (or no releasable edges) is also contemplated.

Figure 6B:
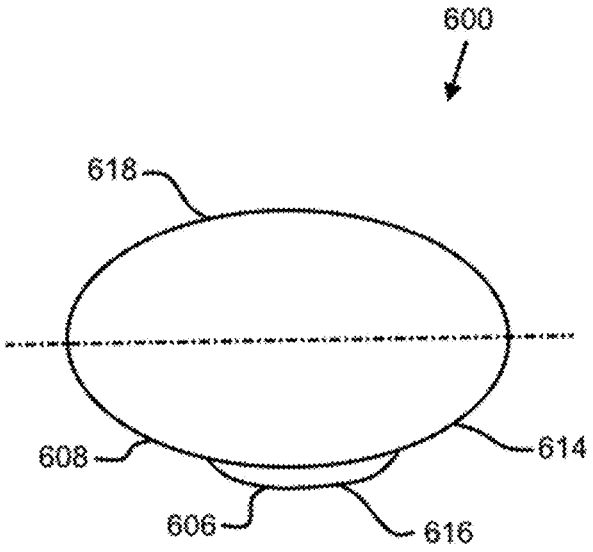
FIG. 6B shows a top view of the article of FIG. 6A.

The knitted component 601 of the sleeve 600 may be formed on a knitting machine. In one embodiment, the knitted component 601 is formed on two needle beds of a flat knitting machine. Referring to FIG. 6B, the sleeve 600 may include three knit layers. A first knit layer 614 may form a first section of the base portion 604 and may be formed on certain needles of a first needle bed. A second knit layer 616 (associated with the strap 606) may be formed on other needles of the first needle bed (as described above with respect to FIG. 4B). A third layer 618, which may form a second section of the base portion 604, may be formed on a second needle bed. The first knit layer 614 and the third knit layer 618 may be secured at their edges (e.g., along the depicted centerline) to thereby form the base portion 604. Each of the knit layers may have different characteristic. For example, the knit structure, size and tension yarns used, the material and size of the yarns used, or any combination thereof may vary between the layers. In one particular example, it may be desirable for the strap 606 to be relatively elastic when compared to the base portion 604 (e.g., when the strap 606 is configured to stretch to allow an object to be inserted into an associated pocket 612), so the second knit layer 616 may be made with a knit structure and/or a material associated with high elasticity.

In other embodiments, additional layers may be provided. For example, it is contemplated that additional straps may be provided to thereby form additional pockets. Accordingly, it is contemplated that a fourth layer may be formed on the second needle bed to form a second strap and pocket associated with the third knit layer 618 of FIG. 6B.

All of the structures and methods disclosed and claimed herein can be made and executed without undue experimentation in light of the present disclosure. While this invention may be embodied in many different forms, specific aspects of the invention are described herein. The present disclosure is an exemplification of the principles of the invention and is not intended to limit the invention to the particular aspects illustrated. In addition, unless expressly stated to the contrary, use of the term "a" is intended to include "at least one" or "one or more." For example, "a yarn" is intended to include "at least one yarn" or "one or more yarns."

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the invention encompasses any and all possible combinations of some or all of the various aspects described herein. It should also be understood that various changes and modifications to the aspects described herein will be apparent to those skilled in the art. Such changes and modifications can be made without departing from the spirit and scope of the invention and without diminishing its intended advantages. It is therefore intended that such changes and modifications be covered by the appended claims.

We claim:

1. An upper for an article of footwear, the upper comprising:

a knitted component having a first portion and a second portion, wherein the first portion of the knitted component comprises an outer surface and at least partially forms a foot-receiving portion of the upper, wherein the second portion of the knitted component at least partially forms a strap of the upper, wherein the strap includes a first edge and a second edge that are both seamlessly secured to the outer surface of the first portion of the knitted component, wherein the first edge is formed via common knitting with the first portion such that the first edge is seamlessly secured to the outer surface of the first portion on a lateral side of the upper via at least one first knit structure, and wherein the second edge is formed via common knitting with the first portion such that the second edge is seamlessly secured to the outer surface of the first portion on a medial side of the upper via at least one second knit structure, wherein the strap includes a third edge, the third edge being a continuous knit edge that extends from the first edge to the second edge such that the third edge extends over a throat area of the upper and such that the strap forms an exterior top surface of the upper in a central region of the throat area and such that the strap entirely extends continuously and seamlessly over the outer surface of the first portion from the first edge, over the throat area, to the second edge.

2. The upper of claim 1, wherein the third edge is a free edge.

3. The upper of claim 1, wherein the strap includes a fourth edge that extends from the first edge to the second edge and is unsecured to the first portion of the knitted component.

4. The upper of claim 1, wherein the third edge of the strap extends over the first portion of the knitted component in an unsecured manner from the lateral side of the upper, over the throat area of the upper, and to the medial side of the upper.

5. The upper of claim 1, wherein the first portion of the knitted component and the second portion of the knitted component are formed together as an integral one-piece element on a knitting machine.

6. The upper of claim 1, wherein the knitted component comprises a first layer including the first portion and a second layer including the second portion.

7. The upper of claim 1, wherein the upper further comprises at least one tension element located in a pocket defined between the foot-receiving portion of the upper and the strap of the upper.

8. The upper of claim 7, wherein the at least one tension element is inserted within the knitted component, and wherein slack of the at least one tension element is pulled into the pocket to form at least one loop.

9. The upper of claim 8, wherein the at least one tension element is associated with a fastening system, and wherein the strap covers at least a portion of the fastening system.

10. The upper of claim 1, wherein a pocket is located between the first portion and the second portion, and wherein the pocket extends across the throat area of the upper.

11. An upper for an article of footwear, the upper comprising:

a knitted component having a first portion and a second portion, wherein the first portion of the knitted component comprises an outer surface and at least partially forms a foot-receiving portion of the upper, wherein the second portion of the knitted component at least partially forms a strap of the upper, wherein the strap entirely extends continuously and seamlessly over the outer surface of the first portion from a lateral side of the upper, over a throat area of the upper, and to a medial side of the upper such that the strap forms an exterior top surface in a central region of the throat area, wherein a pocket between the first portion and the strap extends over the throat area of the upper, wherein the strap includes a first edge and a second edge respectively on the medial side and the lateral side, wherein the first edge is formed via knitting with the first portion on the outer surface of the first portion such that the first edge is seamlessly secured to the first portion on the medial side of the upper via at least one first knit structure, and wherein the second edge is formed via knitting with the first portion on the outer surface of the first portion such that the second edge is seamlessly secured to the first portion on the lateral side of the upper via at least one second knit structure.

12. The upper of claim 11, wherein the strap includes a third edge that extends from the first edge to the second edge such that the third edge extends over the throat area of the upper.

13. The upper of claim 12, wherein the third edge is a free edge.

14. The upper of claim 12, wherein the strap includes a fourth edge that extends from the first edge to the second edge and is unsecured to the first portion of the knitted component.

15. The upper of claim 12, wherein the third edge of the strap extends over the first portion of the knitted component in an unsecured manner from the lateral side of the upper, over the throat area of the upper, and to the medial side of the upper.

16. The upper of claim 11, wherein the first portion of the knitted component and the second portion of the knitted component are formed together as an integral one-piece element on a knitting machine.

17. The upper of claim 11, wherein the knitted component comprises a first layer including the first portion and a second layer including the second portion.

18. The upper of claim 11, wherein the upper further comprises at least one tension element located in the pocket.

19. The upper of claim 18, wherein the at least one tension element is inserted within the knitted component, and wherein slack of the at least one tension element is pulled into the pocket to form at least one loop.

20. The upper of claim 19, wherein the at least one tension element is associated with a fastening system, and wherein the strap covers at least a portion of the fastening system.

* * * * *